United States Patent [19]

Raum

[11] Patent Number: 5,045,370

[45] Date of Patent: Sep. 3, 1991

[54] ORNAMENTAL WINDOW PANE ASSEMBLY

[75] Inventor: Randolph J. Raum, Orange, Calif.

[73] Assignee: Creative Craftsmen Co. Inc., Naperville, Ill.

[21] Appl. No.: 311,474

[22] Filed: Feb. 15, 1989

[51] Int. Cl.[5] ..... B44F 1/06

[52] U.S. Cl. ..... 428/38; 52/311; 156/63; 428/914

[58] Field of Search ..... 52/311; 156/63; 428/38, 428/914

[56] References Cited

U.S. PATENT DOCUMENTS

| | | | |
|---|---|---|---|
| 368,413 | 8/1887 | Morgan et al. | 428/38 X |
| 4,068,441 | 1/1978 | Shaffer | 428/38 X |
| 4,070,782 | 1/1978 | Vasallo | 428/187 X |
| 4,438,165 | 3/1984 | Butler | 428/38 |
| 4,488,919 | 12/1984 | Butler | 428/38 X |

FOREIGN PATENT DOCUMENTS

WO85/04622 10/1985 PCT Int'l Appl. ..... 428/38

OTHER PUBLICATIONS

Infinity Bevel System pp. 1 to 100, copyright 1988, by Randolph Raum, 1650 North Glassell Street, Suite U, Orange, Calif. 92665.

*Primary Examiner*—Henry F. Epstein

[57] ABSTRACT

Disclosed is a window pane employing beveled glass plates formed into a plurality of different clusters. Each cluster includes a connecting plate extending outwardly which has a standardized width that can be joined with a standard linear piece of beveled plate glass. Unique corner, link, and crown clusters are employed, each including, preferably, a pair of connecting plates which are spaced apart the same distance as other connecting plates in adjoining clusters.

6 Claims, 8 Drawing Sheets

NO CONNECTING PLATE

COMMON EDGE

COMMON EDGE. NO CONNECTING PLATE.

ORNAMENTAL WINDOW PANE ASSEMBLY

BACKGROUND OF THE INVENTION

1. Field of the Invention

This invention relates to window panes and particularly window panes including ornamental patterns composed of clusters of beveled glass plates having standardized connecting strips which connect clusters together to form said pattern.

2. Background Discussion

Ornamental windows are used in many applications. One form of ornamental window consists of a window pane including flat plates of glass combined with ornamental clusters of strips of beveled glass plates. Typically these clusters include individual beveled pieces of glass in the form of leaves, teardrops, flower petals, and other ornamental shapes. They are joined together by a strip of lead and tin alloy called "came". This came has an H-shaped cross-section and the edges of the individual ornamental pieces are placed in the adjoining sockets provided by the came.

Clusters of individual beveled glass pieces are sold in packages and typically they cost a hundred dollars or more per package. Designers select from a variety of sources these individual clusters and place them into the window pane which they are constructing. Currently, these designers are limited to the selection of clusters provided by the manufacturers. Designers must select the cluster to fit within the dimensions of the window pane they are constructing. Consequently, the current state of the art provides clusters which are high cost and of limited selection.

SUMMARY OF THE INVENTION

The present invention provides a low cost, modular cluster system which enables designers to create a wide variety of ornamental patterns from a limited number of standard cluster designs quickly and at a substantial cost savings.

There are several features of this invention contributing to its desirable attributes, no single one of which being solely responsible for these desirable attributes. Without limiting the scope of this invention as expressed by the claims, its more prominent features will now be discussed briefly. After considering this discussion, and particularly after reading the section of this application entitled DETAILED DESCRIPTION OF THE PREFERRED EMBODIMENT, one will understand how the features of this invention provide its low cost, variety, and ease of design.

One feature of this invention is the use of a plurality of clusters of beveled glass plates including outwardly extending connecting plates. The connecting plates provide a site for adjoining clusters to be connected together, either directly or through standardized linear, beveled, planar strips of plate glass. Four different types of clusters may be employed: a crown cluster, a link cluster, a hub cluster, and a corner cluster.

The second feature of this invention is that the clusters forming the ornamental pattern within the window pane will generally be derived from the same family in that they comprise glass plates of like dimensions having common ornamental components. For example, the corner cluster, link cluster, and crown cluster may all include the same repeating curlicue pattern made up of individual glass plates. Typically, each of these clusters will have one or a pair of outwardly extending connecting plates. Each connecting plate has a leading edge, and each of these edges will be of the same width. This enables the designer to place the adjacent clusters into alignment with each other where the connecting plates of each cluster are in registration with the leading edges facing each other. These leading edges can be joined together directly in an abutting relationship or they can be connected together by standardized linear beveled strips of plate glass. When pairs of connecting plates are utilized, the pair will be spaced apart a standardized distance.

The third feature of this invention is that the clusters which are to serve as hubs have a standardized circumference that enables other ornamental groups of beveled pieces such as flower petals, leaves, teardrops, etc. with matching curved surfaces to be placed in abutting relationship about the circumference of the hub cluster. Typically, the radius of the circumference is 1 and ½ inch, which abuts a curved surface having a radius of 1 and ½ inch.

The fourth feature of this invention is that the modular cluster system lends itself to the use of linear beveled strips of plate glass in making an ornamental window pane. These are either standardized or nonstandardized lengths of strips of plate glass. These linear strips are of low cost compared with curved plates of glass. Consequently, a substantial cost saving is realized when such linear beveled strips of plate glass are employed.

The fifth feature of this invention resides in the modularity of the clusters. For example, 25 to 50 standard cluster designs can be utilized to make crowns, links, hubs, and corners and these can be joined together either directly or through the linear strips of plate glass to form a wide variety of ornamental patters. The number of different patterns to be derived from using these modular clusters is limited only by the imagination of the designer and the dimensions of the window pane. Because the designer has such a wide selection to choose from, he can offer his customers a selection of different designs.

The sixth feature of this invention is the simplified method of designing a window pane using the modular system of this invention. Printed, reduced in size, ornamental designs of links, hubs, corners, and crowns are releasably placed on a transparent carrier sheet which allows individual cluster designs of reduced size to be transferred from the carrier sheet onto graph paper or the like. By selecting from a variety of these designs, the designer may then create a number of different cluster configurations illustrating different ornamental window pane designs. The designer's customer may then choose which of these designs is most preferred.

BRIEF DESCRIPTION OF THE DRAWING

The drawing, which is for illustrative purposes only and wherein like parts are designated by like numerals, depicts the preferred embodiment of this invention in which.

DETAILED DESCRIPTION OF THE PREFERRED EMBODIMENT

Figure 1:
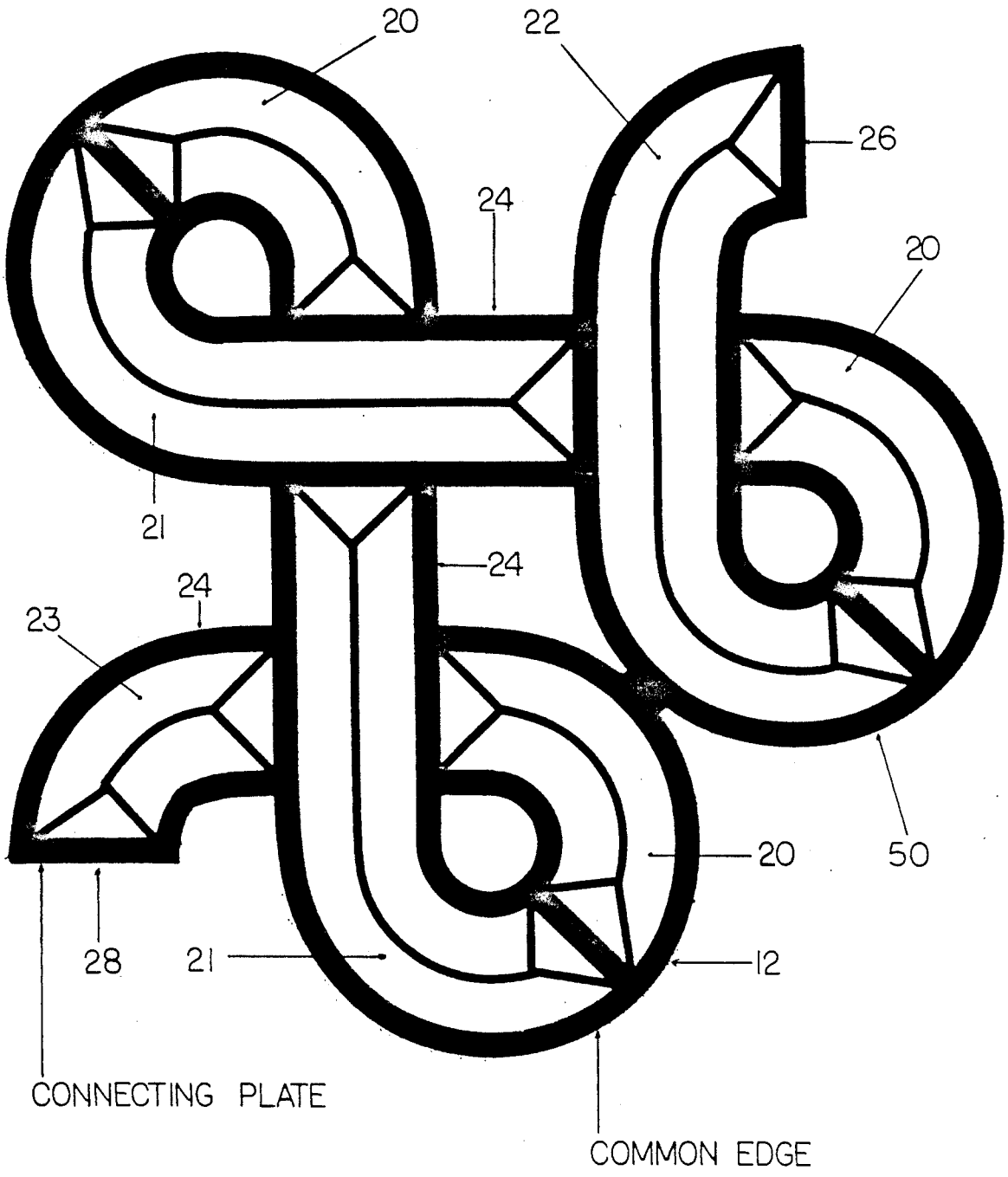
FIG. 1 is a plan view of a corner cluster of the present invention.
Figure 3:
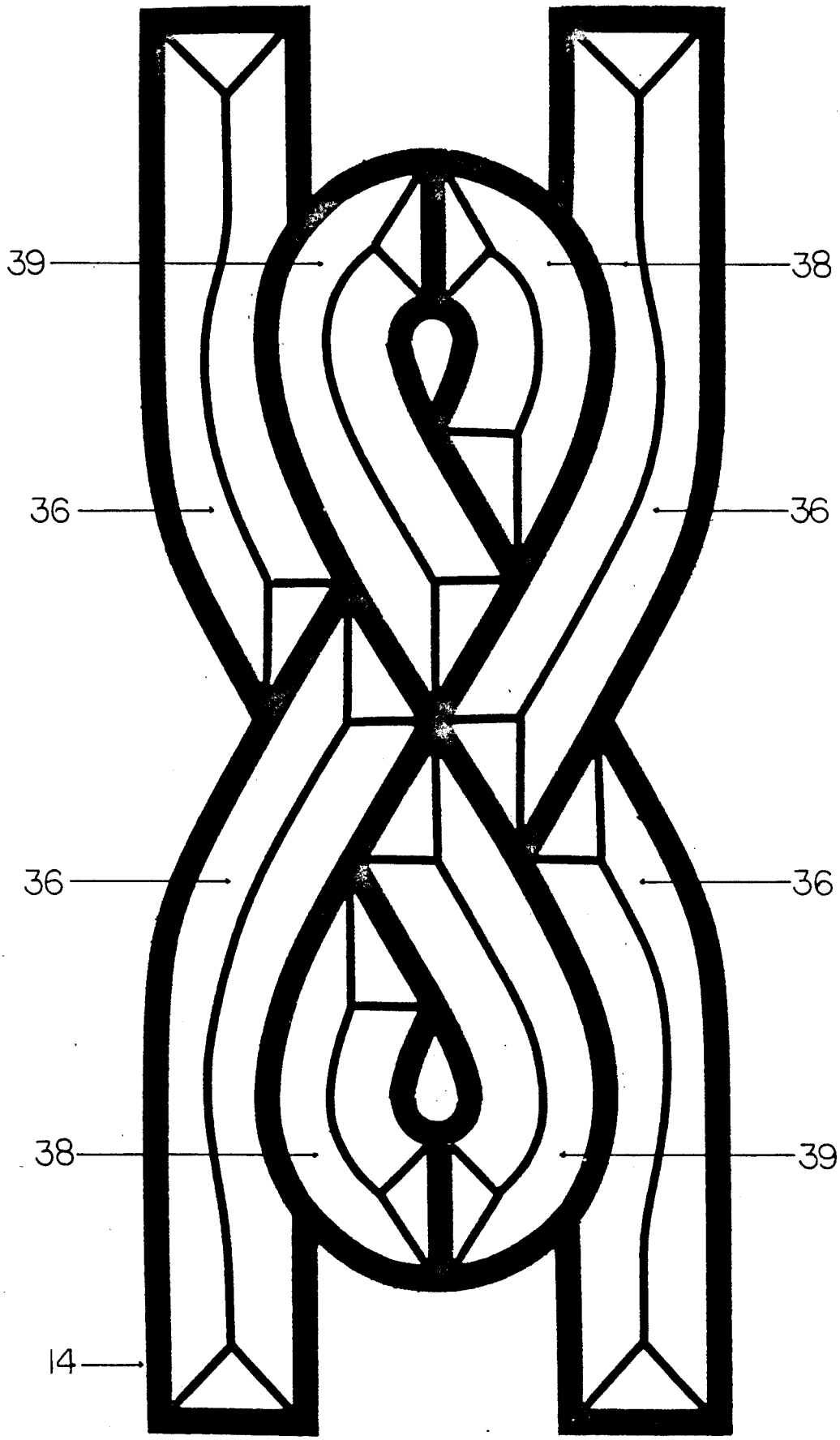
FIG. 3 is a plan view of a link cluster of the present invention.
Figure 4A:
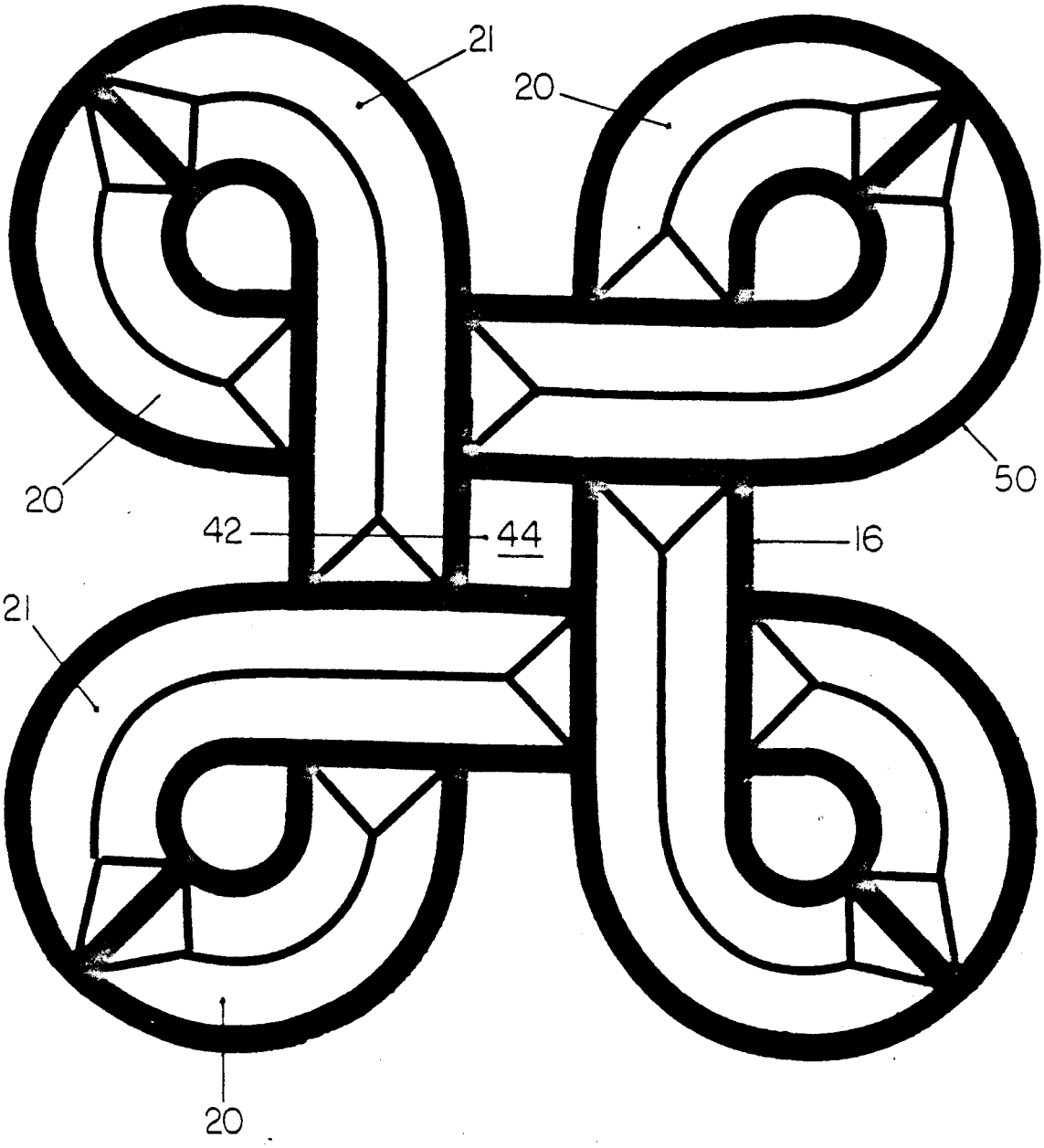
FIGS. 4A and 4B are plan views of hub clusters of the present invention.
Figure 4B:
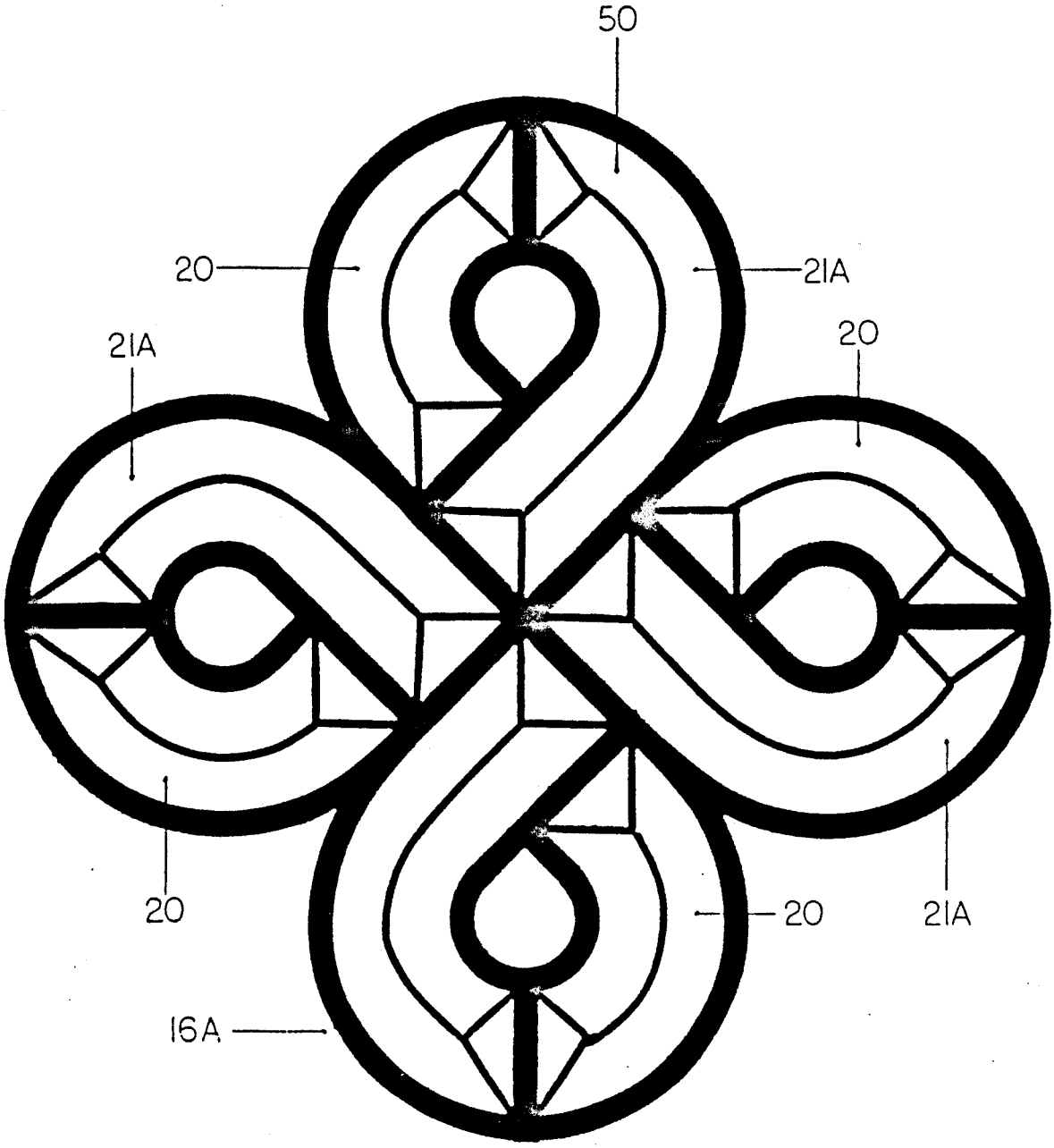
Figure 5A:
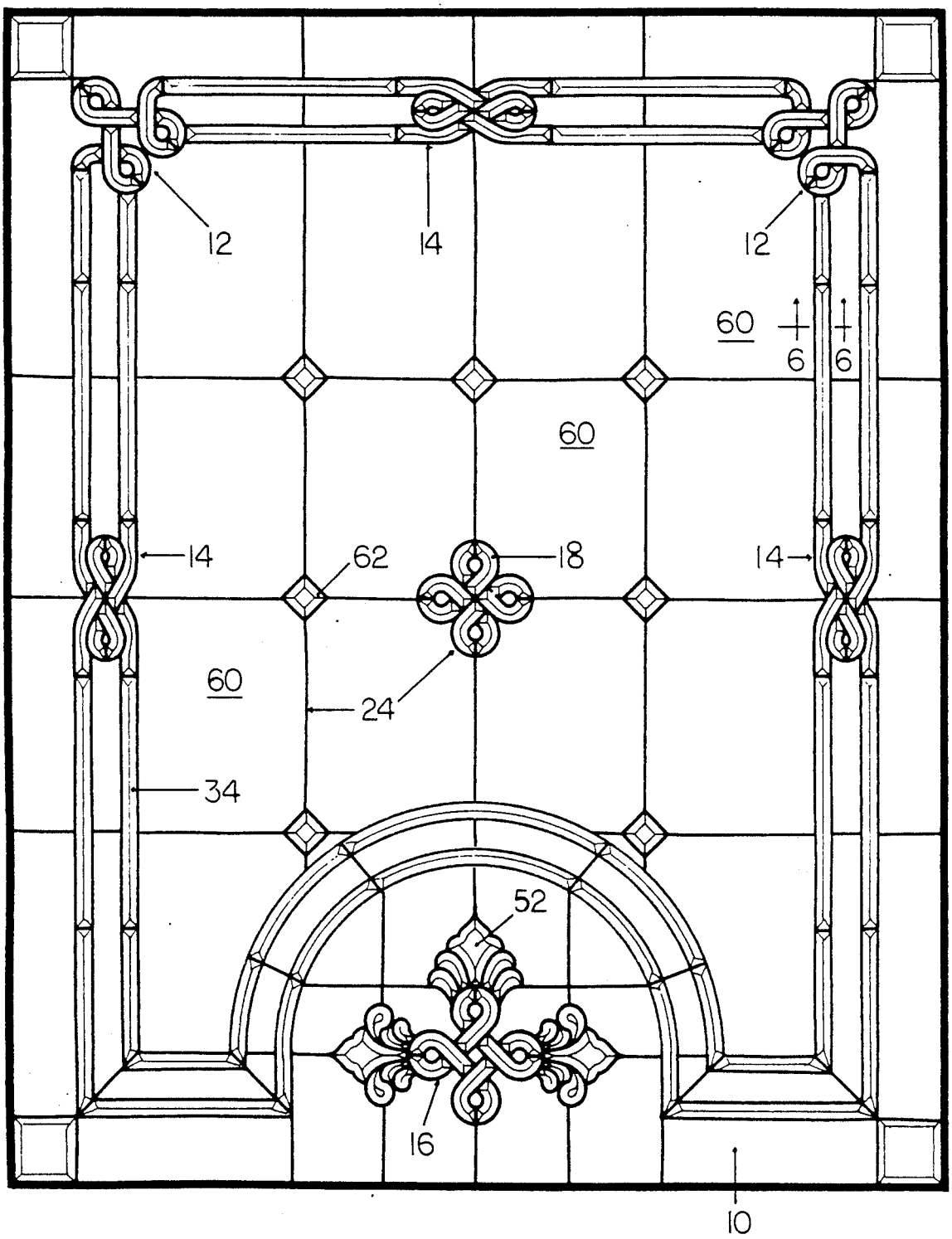
FIGS. 5A and 5B are plan views of window panes employing the cluster system of this invention.

In accordance with this invention, a window pane 10 is made using ornamental, modular clusters repeated in the ornamental pattern as illustrated in FIG. 5A. Three major types of clusters are used to make this window pane 10: a corner cluster (FIG. 1A), a link cluster 14 (FIG. 3), and hub clusters 16 and 16A (FIGS. 4A and 4B, respectively).

The corner cluster 12 comprises beveled, curved plate glass pieces 20, 21, 22, and 23 joined together with came 24. The connecting ends 26 and 28, respectively of the pieces 22 and 23 form one component connecting plates for this corner cluster 12. There are two J-type beveled plate glass pieces 21, three truncated C-shaped beveled glass pieces 20, and two connector pieces 22 and 23 which form the cluster 12. All of the pieces 20–23 are nominally a quarter of an inch thick and one inch in width. Thus, the leading edges of the connecting ends 26 and 28 are all one inch in width.

Figure 2:
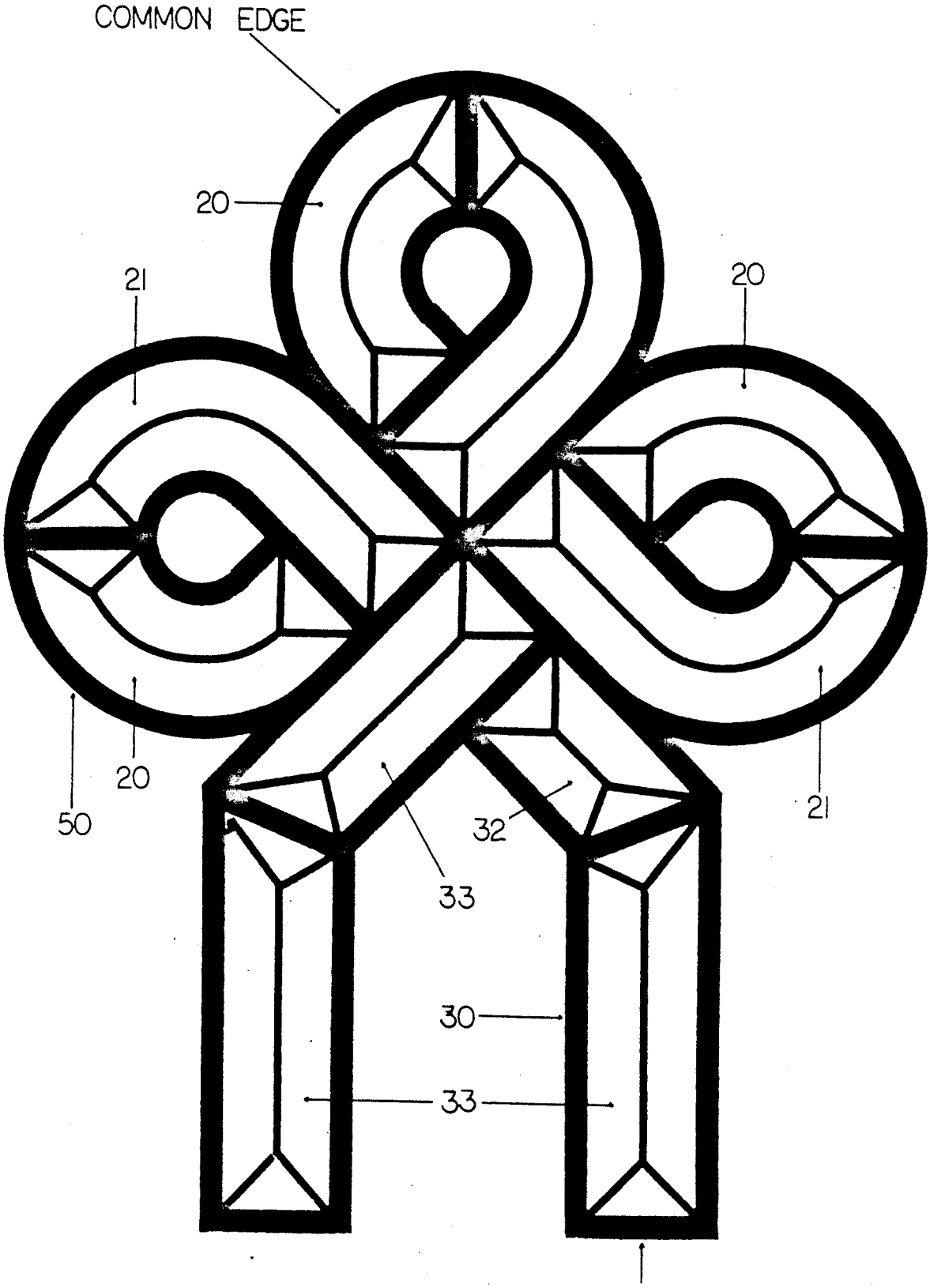
FIG. 2 is a plan view of a crown cluster of the present invention.

A crown cluster 30, as illustrated in FIG. 2, is also made up of beveled pieces 20, 21, 32 and 33 of plate glass joined together by came 24, each plate being a quarter of an inch thick and one inch in width. This crown cluster is also made up of J-pieces 21 and C-pieces 20 to form loops of essentially the same size as the loops of the ornamental pattern in the corner cluster 12. In the crown cluster there are two connecting beveled glass plates 33 extending outwardly and centrally. The outside edges of the connecting plates 33 are four inches apart and the inside edges are two inches apart.

The link cluster 14 shown in FIG. 4 is generally in its overall arrangement a linear-type structure and it is used to join together crown clusters 30, corner clusters 12, and other clusters usually either directly or indirectly using standard linear beveled strips 34 (FIG. 5A) of plate glass. This link cluster 14 includes four outside edge pieces 36 of similar shape and two different type curved pieces 38 and 39 arranged to form an internal loop pattern which is compatible in design with the loops of the other clusters.

Two different types of hub clusters 16 and **16*a* are illustrated, respectively, in FIGS. 4A and 4B. The principal difference between the two clusters 16 and 16*a* is that the pieces 21 are slightly longer than the pieces 21*a* used in cluster 16*a*. This difference results in the cluster 16 having a diamond opening 42 centrally located with the loops 50 surrounding this opening. The opening is filled with flatplate glass 44. Hub cluster 16*a* does not have the opening 42, and the loops 50** about each other.

Figure 5B:
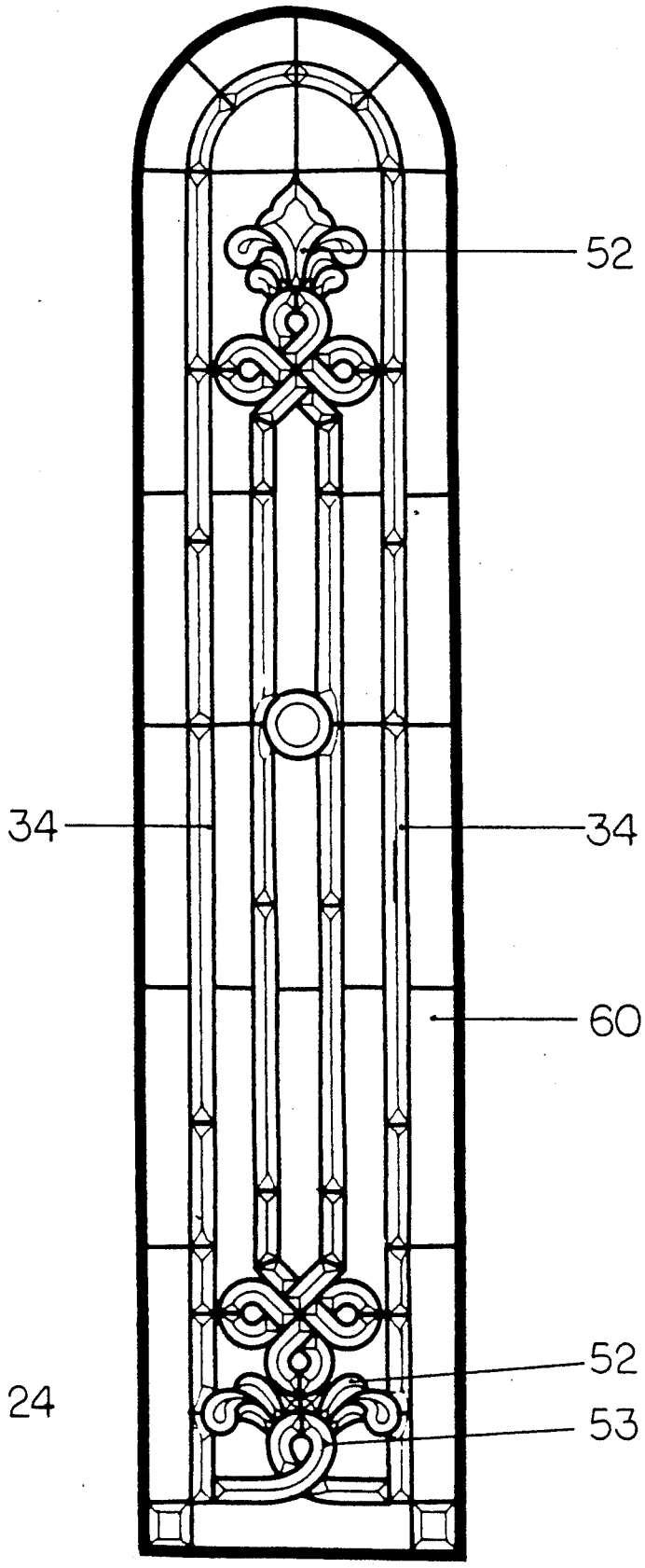
Figure 6:
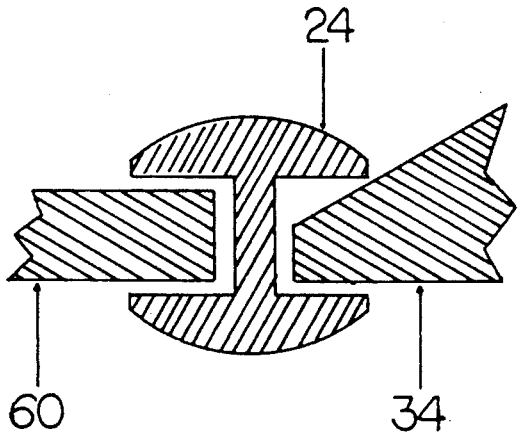
FIG. 6 is a cross-sectional view taken along line 6—6 of FIG. 5A.

The corner cluster 12, crown cluster 30, and hub clusters 16 and **16*a* with the outwardly extending loops provide sites along the circumference of the loops 50 to join other types of clusters with the loops. As shown in FIGS. 5A and 5B, the other types of clusters may be in the form of petals 52 which have curved edges 53 that have a complimentary curvature with the circumference of the loops 50. This allows the petals 52 to be brought into an abutting like arrangement with the loop circumference, with the came 24 holding the petals and loops 50** in position.

Thus, the corner clusters 12, crown clusters 30, hub clusters 16 and **16*a*, and link cluster 14 form a family of designs which are modular can be repeated throughout an ornamental pattern in a window pane as illustrated in FIGS. 5A and 5B. The connecting plates 36 of the link cluster 14 are arranged in pairs with each pair extending outwardly in an opposite direction from the other pair. This enables the linkclusters 14** to be arranged in a row in a linear fashion to form borders or internal designs within the pane of glass.

As depicted in FIGS. 5A and 5B, a window pane using the cluster system of this invention consists of flat plates 60 of glass which are nonbeveled connected to the cluster of beveled pieces as illustrated to form the ornamental pattern. The came 24 is used to connect the individual beveled pieces of glass with the flat plates of glass to form the ornamental pattern. As is typical in window pane design using beveled glass pieces, accent pieces 62 may also be employed, but such accent pieces do not form a part of this invention.

Only two different ornamental patterns of clusters have been illustrated. A wide variety, however, can be designed, giving the designer a large variety of basic modular units to select from to create an infinite number of ornamental patterns for different size window panes. Because of this novel cluster design concept using connecting plates and common curved edges in the cluster, the designer can quickly create several different ornamental patterns to fit a given window pane. The inventor has published a book entitled "Infinity Bevel System", which is attached here as Appendix A, illustrating the variety of designs to which his invention lends itself.

By utilizing a carrier sheet a design may create sample window pane configurations on paper and then show these configurations to a customer who will then select the one he desires. According to this aspect of the invention a transparent carrier sheet has printed thereon pictures of a wide variety of reduced size corner, hub, link, and crown clusters. Conventional image release techniques are employed which allow, upon application of pressure with, for example, a pencil, the transfer of the image from the carrier sheet to paper. The images of the selected clusters are transferred from the carrier sheet to the paper in the relative positions selected by the designer. The designer thus has the capability to select from a variety of clusters which to use to create a unique window pane design.

SCOPE OF THE INVENTION

The above description presents the best mode contemplated of carrying out the present invention as depicted by the embodiments disclosed. The combination of features illustrated by these embodiments provide the cost savings, ease of design, and variety of this invention. This invention is, however, susceptible to modifications and alternate constructions from the embodiments illustrated in the drawing and described above. For example, the clusters illustrated employ curvilinear planar strips to form "celtic knots." This is not the only type of cluster design which may be employed using this invention. Consequently, it is not the intention to limit it to the particular embodiments disclosed. On the contrary, the intention is to cover all modifications and alternate constructions falling within the scope of the invention as generally expressed by the following claims.

What is claimed is:

1. A window pane comprising, at least in part, a plurality of clusters of beveled glass plates, said clusters being in the plane of the window pane and arranged to provide an ornamental pattern within the window pane, each cluster having an outwardly extending end plate having a leading edge of predetermined width, with the width of the leading edges of the end plates of all the clusters forming said ornamental pattern being essentially of the same dimension, with the end plates of adjacent clusters aligned with each other to arrange the leading edges in registration facing each other.

2. The window pane of claim 1 wherein the clusters comprise at least two different ornamental designs, each different ornamental design being replicated and repeated in other clusters making up said ornamental pattern.

3. The window pane of claim 2 wherein the two different ornamental designs are from the same family of designs in that they comprise glass plates of like dimensions having common ornamental components.

4. The window pane of claim 3 wherein each cluster has a pair of end plates with the leading edges of each plate having the same width and the distance between each of said plates comprising a given pair being essentially the same as the distance between end plates of other clusters comprising said ornamental pattern.

5. The window pane of claim 1 wherein the ornamental design of the window pane is created from reduced size images of the clusters employed releasably carried on a sheet and transferred therefrom to paper or the like to form said ornamental design.

6. A window pane comprising, at least in part, a plurality of clusters of beveled glass plates in the form of curvilinear planar strips having opposed terminal ends, said terminal ends having a width equal to the width of a standard linear beveled strip, said clusters being in the plane of the window pane and arranged in an ornamental pattern within the window pane, each cluster having a pair of outwardly extending connecting plates, with the width of all the connecting plates being the same for all the clusters forming said ornamental pattern, with different clusters being connected to each other by standard linear connecting strips to form said ornamental pattern.

* * * * *